US009771535B2

(12) United States Patent
Zhao et al.

(10) Patent No.: US 9,771,535 B2
(45) Date of Patent: Sep. 26, 2017

(54) GASOLINE EFFICACY PROMOTER (GEP) AND METHOD OF MAKING THE SAME

(71) Applicants: Joe Ru He Zhao, Vancouver (CA); Yu Ping Zhang, Burnaby (CA); Jing Hua Cao, Vancouver (CA); Jiao Jiao Sun, Burnaby (CA)

(72) Inventors: Joe Ru He Zhao, Vancouver (CA); Yu Ping Zhang, Burnaby (CA); Jing Hua Cao, Vancouver (CA); Jiao Jiao Sun, Burnaby (CA)

( * ) Notice: Subject to any disclaimer, the term of this patent is extended or adjusted under 35 U.S.C. 154(b) by 163 days.

(21) Appl. No.: 14/830,197

(22) Filed: Aug. 19, 2015

(65) Prior Publication Data

US 2017/0051220 A1 Feb. 23, 2017

(51) Int. Cl.

| | |
|---|---|
| ***C10L 1/32*** | (2006.01) |
| ***C10L 1/10*** | (2006.01) |
| *C10L 1/12* | (2006.01) |
| *C10L 1/18* | (2006.01) |
| *C10L 1/24* | (2006.01) |

(52) U.S. Cl.

CPC ..... *C10L 1/324* (2013.01); *C10L 1/10* (2013.01); *C10L 1/125* (2013.01); *C10L 1/1208* (2013.01); *C10L 1/1802* (2013.01); *C10L 1/2437* (2013.01); *C10L 2200/0295* (2013.01); *C10L 2230/14* (2013.01); *C10L 2230/22* (2013.01); *C10L 2250/084* (2013.01); *C10L 2250/086* (2013.01); *C10L 2270/023* (2013.01); *C10L 2290/08* (2013.01); *C10L 2290/24* (2013.01); *C10L 2290/34* (2013.01)

(58) Field of Classification Search

CPC ..... C10L 2250/086
USPC ..... 44/300–459
See application file for complete search history.

(56) References Cited

U.S. PATENT DOCUMENTS

| | | | | |
|---|---|---|---|---|
| 4,083,698 | A * | 4/1978 | Wenzel | B01F 17/0092 44/301 |
| 4,396,400 | A * | 8/1983 | Grangette | C10L 1/10 44/301 |
| 4,451,265 | A * | 5/1984 | Schwab | C10L 1/026 44/302 |
| 4,451,267 | A * | 5/1984 | Schwab | C10L 1/026 44/302 |
| 4,477,258 | A * | 10/1984 | Lepain | C10L 1/328 44/302 |
| 4,608,057 | A * | 8/1986 | Davis | C10L 1/328 44/281 |
| 4,744,796 | A * | 5/1988 | Hazbun | C10L 1/328 44/302 |
| 5,004,479 | A * | 4/1991 | Schon | C10L 1/328 44/302 |
| 5,782,556 | A * | 7/1998 | Chu | F23K 5/12 366/155.1 |
| 6,348,074 | B2 * | 2/2002 | Wenzel | C10L 1/10 44/302 |
| 7,575,607 | B2 * | 8/2009 | Lif | B01F 17/0042 44/301 |
| 7,887,604 | B1 * | 2/2011 | Hicks | C10L 1/14 44/301 |
| 7,977,389 | B2 * | 7/2011 | Strey | C10L 1/328 516/58 |
| 2002/0095859 | A1 * | 7/2002 | Hicks | C10L 1/10 44/447 |
| 2013/0074396 | A1 * | 3/2013 | Núñez | C10L 1/326 44/282 |

* cited by examiner

*Primary Examiner* — Ellen McAvoy

(57) ABSTRACT

The present invention discloses a gasoline efficacy promoter (GEP) boosting combustion efficiency of gasoline in internal combustion engines by a mechanism of micro-dissociation comprising a microemulsion of modified bio-carbon, a surfactant, water, a modified vegetable oil and a dispersant, and a method of making it. The gasoline efficacy promoter, environmentally friendly and stable for longer than six months, can increase the combustion efficiency by more than 10%, and reduce 80% of $NO_x$ formation in exhaust emission when an appropriate dosage is added to a fuel tank in a vehicle.

18 Claims, No Drawings

GASOLINE EFFICACY PROMOTER (GEP) AND METHOD OF MAKING THE SAME

FIELD OF THE INVENTION

The present invention generally relates to a gasoline additive. More particularly, the present invention relates to an environmentally friendly gasoline efficacy promoter (GEP) containing a microemulsion of modified bio-carbon, a surfactant, water, a modified vegetable oil and a dispersant, and a method of making it.

BACKGROUND OF THE INVENTION

According to the Energy Information Administration (EIA), global consumption of petroleum and other liquid fuels was 92.4 million barrels per day in the year of 2014, and vehicles consumed about 50% of them. As a result, a great amount of emitted gases such as carbon dioxide, $NO_x$, greatly polluted our environment. Because of the development of the automotive industry, particularly in the developing countries, more vehicles have been manufactured. Accordingly the consumption of petroleum and other liquid fuels such as gasoline and diesel is increasing, The combustion efficiency of fuels in internal combustion engines affects the consumption of fuels and gas emission. In a new internal combustion engine, the combustion efficiency is normally 68%-75%. However in an older engine the efficiency may drop to 50%-55% or lower. To boost the fuel combustion efficacy, many techniques have been developed in last decades. These developments include two main aspects: (1) the optimization of engine systems, for example, optimization of gasoline supply systems, atomizing systems, and computerized air/gas ratio injection, etc. (2) to maintain the fuel supply system in good conditions and to improve properties of fuels in engines to provide better combustion. This can mainly be done by addition of additives to the fuels. The additives include various types of cleansing agents or cleaners, combustion boosters, etc. Water based microemulsion is a typical fuel additive for this purpose. The introduction of water to gasoline was found to reduce emission of particulates by 20%-60% and reduce formation of $NO_x$ by 10%-50%. This is attributed to a lower combustion temperature and a so-called "micro-explosion" in engines which disperses fuel droplets by explosive vaporization, and atomizes the fuel effectively. Most additives were comprised of hydrocarbon fuel, water, various alcohols and surfactants. For example, U.S. Pat. No. 5,004,479 to Schon et al discloses a microemulsion fuel comprised of gasoline, methanol, water, and a surfactant blend having a hydrophilic-lipophilic balance value of 3 to about 4.5. U.S. Pat. No. 4,083,698 to Wenzel et al describes fuel compositions which are water-in-oil emulsions and comprise a hydrocarbon fuel such as gasoline or diesel fuel, water, a water-soluble alcohol such as methanol, ethanol or isporpoanol, and a combination of surface-active agents. U.S. Pat. No. 4,451,265 to Schwab describes microemulsion fuel compositions prepared from diesel fuel, water, lower water-miscible alcohols and a surfactant system comprising N,N-dimethyl ethanol amine and a long-chain fatty acid. U.S. Pat. No. 4,451,267 to Schwab et al claims microemulsions prepared from vegetable oil, a $C_1$-$C_3$ alcohol, water and a lower trialkyl amine surfactant, and discloses the optional addition of 1-butanol as a cosurfactant for the purpose of lowering both the viscosity and the solidification temperature of the microemulsion.

Instability of the microemulsion fuel compositions described above has been a disadvantage under conditions to which the fuels have been exposed. Incorporated water will separate, causing problems in storage reservoirs, such as corrosion and bacterial growth. Moreover, water droplets become entrained in filters causing swelling and distortion, yielding unexpected blockage of the supply system from the reservoir, clogging of pumps, etc. The water droplets also form ice crystals in cold weather, causing frosting and blockage of engines.

To improve the stability of the microemulsion, many techniques have been proposed. For example, U.S. Pat. No. 4,744,796 to Hazbun et al proposed a method of improving the stability by adding a cosurfactant combining tertiary butyl alcohol and an ionic or nonionic surfactant. U.S. Pat. No. 5,004,479 to Schon et al disclosed a microemulson using methanol and a fatty acid partially neutralized by a nitrogenous base.

Another factor affecting the stability of the microemulsion is the amount of the water incorporated. In prior art, a water content of 10,000 to 400,000 parts per million (ppm) in the fuel is generally accepted as necessary to achieve any worthwhile improvement in combustion. However, in order to achieve even short term fuel emulsion stability at the high water contents, significantly large quantities of expensive emulsifying surfactants are required (typically 5,000 to 200,000 ppm). The surfactants at a high cost make fuel emulsions with high water content unsuitable for commercial applications. U.S. Pat. No. 4,396,400 to Grangette et al claims that 1,000 ppm of emulsified water with 500 ppm of surfactant gives the optimum improvement. In fact, 500 ppm of surfactant would still be too expensive for commercial applications. Grangette et al also discloses that it is possible to produce "ultra-low" water content fuel emulsions by adding 100 ppm of water, but employing only 25 ppm of a single "crude" surfactant. With so much water and so little surfactant, the resulting fuel emulsion would not be stable enough for commercial applications.

It is known that a large amount of water can improve combustion efficiency and reduce emissions. However, increased water content adversely affects the stability. Hicks et al, in U.S. Pat. Pub. No. 2002/0095,859A1, proposed a way to improve the fuel combustion keeping a good stability. The improved combustion and efficiency can be achieved by adding as little of the composition as needed to result in 5 to 95 ppm of water in the hydrocarbon fuel. Stability of this low water content of microemulsion fuel is achieved with use of surfactant/water ratios at 8:1 to 0.5:1, preferably 3.0:1 to 1.0:1, and most preferably 2.5:1. The resulting microemulsion fuel exhibits improved fuel economy and reduced exhaust emission. U.S. Pat. No. 7,887,604B1 to Hicks et al proposed another way to reduce the amount of water in the fuel microemulsion. U.S. Pat. No. 4,608,057 to Davis et al provides another method to modify hazed water gasoline into stable gasoline additive by blending the haze fuel with nonionic surfactant made from an alkanoic acid derivative. In U.S. Pat. No. 4,477,258, Lepain proposes a method to create stable water-in-oil type diesel fuel emulsion by introducing a mixture of methanol and ethanol and water soluble, ethoxylated, non-ionic surfactant.

Despite the improved ability achieved by a lot of efforts in the prior art, the efficiency of these microemulsions depend on water content. In addition, they are mixtures containing a fuel, either diesel or gasoline, which could possess safety and corrosion issue during fuel storage.

Therefore, there is a need to develop an additive with higher efficiency, safety and stability to overcome the problems.

The following patents are cited:

U.S. Patents:

| | |
|---|---|
| 5,004,479 | Schon et al |
| 4,083,698 | Wenzel et al |
| 4,451,265 | Schwab |
| 4,451,267 | Schwab et al |
| 4,744,796 | Hazbun et al |
| 4,396,400 | Grangette et al |
| 7,887,604B1 | Hicks et al |
| 4,608,057 | Davis, et al |
| 4,477,258 | Lepain |
| 2002/0095,859A1 | Hicks et al |

SUMMARY OF THE INVENTION

The present invention generally relates to a gasoline additive. More particularly, the present invention relates to an environmentally friendly gasoline efficacy promoter (GEP) containing a microemulsion of modified bio-carbon, a surfactant, water, a modified vegetable oil and a dispersant.

The present invention also discloses a method of making the gasoline efficacy promoter (GEP). The method consists of the steps: (1) The modified bio-carbon is made from activated carbon (AC), with repeated purification in acidic solutions and basic solutions. (2) Microemulsion of modified bio-carbon and water is made by ultrasonication with an anionic surfactant. (3) The microemulsion of modified bio-carbon and water is dewatered and dried to a proper concentration. (4) Modification of a vegetable oil by a sodium hydroxide solution. (5) The gasoline efficacy promoter (GEP) is formed by mixing the microemulsion of modified bio-carbon, the modified vegetable oil, a dispersant and water.

The gasoline efficacy promoter (GEP) disclosed in the present invention can increase combustion efficiency of gasoline in internal combustion engines by more than 10%, reduce 80% of $NO_x$ formation in exhaust emission when 50 ml is added to a fuel tank of 50 litres in a vehicle. It is stable, no separation has been observed in a 6-months stability test.

DETAILED DESCRIPTION OF THE INVENTION

The present invention provides a novel gasoline efficacy promoter (GEP) that boosts the gasoline combustion efficacy by incorporating modified bio-carbon in microemulsion and performs a micro-dissociation process in internal combustion engines. The invention permits a considerable improvement in combustion of gasoline.

The invention results from three improvements: (1) Modified bio-carbon is used as a water carrier and booster for micro-explosion. (2) Long term of stability of microemulsion of modified bio-carbon, water, modified vegetable oil, surfactants and dispersants is reached by ultrasonication. (3) A low water incorporation ratio, typically less than 0.5% in the invention, was found to be optimum water content for better gasoline combustion in internal combustion engines.

The invention includes two processes. First is to make a microemulsion of modified bio-carbon and water. Second is to make the GEP by mixing the microemulsion of modified bio-carbon, water, a modified vegetable oil and a dispersant.

The invention includes modified bio-carbon made from activated carbon (AC) as a water carrier which improves fuel combustion by micro-dissociation of water in bio-carbon to provide high momentum of carbon particles to bombard liquid fuel droplets and enhance atomization, thus increasing surface area and boosting fuel combustion. At engine temperature of 250° C. to 400° C., water will become vapor with a high pressure, which breaks down the bio-carbon to smaller particles. These micro particles will bombard the fuel droplets to decreased sizes and increased surface area. Therefore the process boosts the fuel combustion efficacy.

The AC made from natural sources, such as wood, coal, coconut shell, etc., is called as bio-carbon which is non-identical to the AC from other sources. Modification of bio-carbon to become modified bio-carbon is conducted by undergoing purifications of AC surfaces. The modified bio-carbon is typically attractive at a low cost and is available with sufficiently high surface areas.

In some embodiments, the AC has a bulk density in a range of about 0.2 to 0.4 g/ml; such as in the range of about 0.35 to 0.4 g/ml.

In some embodiments, the AC has a BET surface area of about 1,700 to 3,200 $m^2/g$, such as about 1,700 to 2,500 $m^2/g$; such as about 1,700 to 2,000 $m^2/g$.

In some embodiments, the AC has a pore volume of about 0.8 to 2.2 ml/g, such as about 1.0 to 2.0 ml/g.

In some embodiments, the AC is washed with at least one acidic solution to reduce calcined ash.

In some embodiments, the AC is washed with at least one basic solution to reduce calcined ash.

In some embodiments, the AC is washed with a plurality of increasingly basic solutions to reduce calcined ash. In some embodiments, the AC is washed with at least one acid and at least one base to reduce calcined ash. In some embodiments, the AC is washed with at least one acid followed by at least one base to reduce calcined ash.

In some embodiments, the plurality of increasingly basic solutions includes three or more increasingly basic solutions. In some embodiments, the plurality of increasingly basic solutions comprises an aqueous ammonium hydroxide solution. In some embodiments, the plurality of increasingly basic solutions comprises an aqueous alkali or alkali earth hydroxide solution.

In some embodiments, the method further comprises washing the AC generated previously with at least one acidic solution prior to washing with said plurality of basic solutions. In some related embodiments, at least one acidic solution comprises an aqueous hydrochloric acid solution, an aqueous nitric acid solution, or a mixture thereof.

After the washing process is complete, the resulting AC may be dried by any method known in the art. In some embodiments, an indirectly heated rotary dryer may be used to dry the washed AC to reach desired moisture content. For example, the washed AC may be dried at a temperature of about 150 to 300° C. with a drying rate of about 200 to 500 kg/hr. After drying, the AC is physically stable black granules, preferably with moisture content of less than about 4%, such as a less than about 3%, such as less than about 2%.

Freshly dried bio-carbon is dispersed in water with an anionic surfactant under ultrasonication. Typically an anionic surfactant contains anionic functional group at its head, such as sulfate, sulfonate, phosphate, and carboxylate. A prefer surfactant containing alkyl sulfates includes ammonium lauryl sulfate, sodium lauryl sulfate (SDS, sodium dodecyl sulfate, another name for the compound) and the related alkyl-ether sulfates such as sodium laureth sulfate, also known as sodium lauryl ether sulfate (SLES), and sodium myreth sulfate. The concentration of surfactant in water is in the range of 1% to 10% by weight, preferably in a range of 2% to 8%. The surfactant is mixed with the modified bio-carbon at a concentration of 100 ppm to 1,500 ppm, more preferably 200 ppm to 500 ppm.

The time for ultrasonication is 3 min to 360 min, preferably 5 min to 120 min, more preferably 6 min to 60 min.

The well dispersed suspension of the modified bio-carbon in water is dewatered and dried at a temperature of 80° C. to 100° C. to a concentration of 33% to 65%. The condensed AC suspension is dispersed in a surfactant solution at a concentration of 2% to 15%, typically 4% to 10%, more preferably 5% to 8%.

The well dispersed microemulsion is verified using Tyndall effect, and is left for sedimentation for about 48 hours. The supernatant of the suspension is collected for next process. The supernatant of the suspension is called as microemulsion of modified bio-carbon.

Vegetable oils used in the invention can be any triglyceride vegetable oils, typically such as palm, soybean, rapeseed oil, etc.

The vegetable oil is modified by removing the glycol portion under a basic condition, when heated with continuous agitation. The vegetable oil can be modified by sodium hydroxide at a concentration of 5% to 20%, preferably 5% to 8%. The reaction time can be 50 min to 2 hours with a heating temperature of 70° C. to 130° C., preferably 80° C. to 100° C. After reaction, the top portion of the solution is collected as modified vegetable oil.

The GEP is made from the microemulsion of modified bio-carbon, water, modified vegetable oil and a dispersant, with agitation at a high shear.

The dispersant is a mixture of a nonionic surfactant and a solvent. The surfactant can be any polyoxyethylene glycol octylphenol ethers, like triton X-100, glycerol alkyl esters, sorbitan alkyl esters. The solvent can be water and other solvents.

The weight ratio of the microemulsion of modified bio-carbon to the dispersant is 0.2 to 2, preferably 0.8 to 1.2.

The stability of the GEP in the invention showed pronounced stability for period of longer than 6 months.

The components of the invention are listed in Table 1.

TABLE 1

Components of Gasoline Efficacy Promoter (GEP)

| Components | Weight % |
|---|---|
| Modified bio-carbon | 0.002-2 |
| Water | 0.005-4.5 |
| Surfactant | 0.005-0.05 |
| Dispersant | 0.06-0.5 |
| Modified vegetable oil | 93-98 |

Although preferred embodiments have been described and depicted in detail herein, it will be apparent to those skilled in the relevant art that various modifications, additions, substitutions, and the like can be made without departing from the spirit of the present invention and these are therefore considered to be within the scope of the present invention as defined in the claims which follow.

What is claimed is:

1. A microemulsion of a gasoline efficacy promoter comprising a bio-carbon, a surfactant, water, a vegetable oil and a dispersant.

2. A microemulsion according to claim 1 wherein the bio-carbon is made from activated carbon of natural sources.

3. A microemulsion according to claim 1 wherein the bio-carbon has a bulk density in a range of 0.2 to 0.4 g/ml, a BET surface area of 1,700 to 3,200 $m^2/g$, and a pore volume of 0.8 to 2.2 ml/g.

4. A microemulsion according to claim 1 wherein the bio-carbon is modified by washing with at least one acidic solution to reduce calcined ash.

5. A microemulsion according to claim 1 wherein the bio-carbon is modified by washing with at least one basic solution to reduce calcined ash.

6. A microemulsion according to claim 1 wherein the bio-carbon is 0.002% to 2% by weight.

7. A microemulsion according to claim 1 wherein the surfactant is an anionic surfactant containing anionic functional groups at the head, which are sulfates, sulfonates, phosphates and carboxylates.

8. A microemulsion according to claim 1 wherein the surfactant is 0.005% to 0.05% by weight.

9. A microemulsion according to claim 1 wherein the vegetable oil is made from triglyceride vegetable oils which are palm, soybean, and rapeseed oil.

10. A microemulsion according to claim 1 wherein the vegetable oil is made by removing glycol portion under a basic condition with a sodium hydroxide solution.

11. A microemulsion according to claim 1 wherein the vegetable oil is 93% to 98% by weight.

12. A microemulsion according to claim 1 wherein the dispersant is a mixture of a nonionic surfactant and a solvent which are polyoxyethylene glycol octylphenol ethers, glycerol alkyl esters, and sorbitan alkyl esters.

13. A microemulsion according to claim 1 wherein the dispersant is 0.06% to 0.5% by weight.

14. A microemulsion according to claim 1 wherein the water is 0.005% to 4.5% by weight.

15. A method of preparing a microemulsion of a gasoline efficacy promoter comprising the steps of (1) The bio-carbon is made from activated carbon with repeated purification in acidic solutions and basic solutions;

(2) Microemulsion of the bio-carbon and water is made by ultrasonication with an anionic surfactant;

(3) The microemulsion of the bio-carbon and water is dewatered and dried to an appropriate concentration;

(4) Modification of a vegetable oil by a sodium hydroxide solution;

(5) The microemulsion of a gasoline efficacy promoter is formed by mixing the microemulsion of the bio-carbon, the vegetable oil, the dispersant and water.

16. A method according to claim 15 wherein the time for ultrasonication is 3 min to 360 min.

17. A method according to claim 15 wherein the bio-carbon in water is dewatered and dried at a temperature of 80° C. to 100° C. to a concentration of 33% to 65%.

18. A method according to claim 15 wherein the vegetable oil is modified by sodium hydroxide at a concentration of 5% to 20% with a reaction time of 50 min to 120 min at a temperature of 70° C. to 130° C.

* * * * *